US009726423B1

(12) United States Patent
Swarnkar

(10) Patent No.: US 9,726,423 B1
(45) Date of Patent: Aug. 8, 2017

(54) SLIDING SHELF ASSEMBLY FOR A REFRIGERATOR APPLIANCE

(71) Applicant: General Electric Company, Schenectady, NY (US)

(72) Inventor: Rajesh Swarnkar, Bangalore (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/091,608

(22) Filed: Apr. 6, 2016

(51) Int. Cl.

| | |
|---|---|
| ***A47B 96/04*** | (2006.01) |
| ***F25D 25/02*** | (2006.01) |
| ***F25D 23/02*** | (2006.01) |
| ***A47B 96/07*** | (2006.01) |

(52) U.S. Cl.
CPC ..... *F25D 25/024* (2013.01); *A47B 96/07* (2013.01); *F25D 23/028* (2013.01); *F25D 2325/021* (2013.01)

(58) Field of Classification Search
CPC ..... F25D 25/024; F25D 23/028; F25D 2325/021; A47B 96/07; A47B 96/16
USPC ..... 312/273, 274
See application file for complete search history.

(56) References Cited

U.S. PATENT DOCUMENTS 1,227,813 A * 5/1917 Mahoney ..... A47B 96/16 109/47
1,835,847 A * 12/1931 Chandler ..... F25D 25/02 126/340
2,095,811 A * 10/1937 Goulooze ..... F25D 25/024 126/337 R
2,761,751 A * 9/1956 Stockton ..... F25D 25/024 312/274
5,005,729 A * 4/1991 Hollman ..... B65F 1/1436 220/23.83
5,299,863 A * 4/1994 Albright, Jr. ..... F25D 25/024 312/404
5,474,374 A * 12/1995 Sandvig ..... A47B 96/16 312/271
5,810,462 A * 9/1998 Lee ..... F25D 25/027 312/130
6,220,682 B1 * 4/2001 Vertullo ..... A47B 46/00 312/334.24
6,253,568 B1 7/2001 Peffley
8,267,493 B2 9/2012 Kim
8,277,004 B2 10/2012 Chung
8,454,103 B2 6/2013 Jeon et al.
(Continued)

FOREIGN PATENT DOCUMENTS

JP 2004093039 A 3/2004
WO WO2009115277 A2 9/2009
WO WO2011141569 A2 11/2011

*Primary Examiner* — Hanh V Tran
(74) *Attorney, Agent, or Firm* — Dority & Manning, P.A.

(57) ABSTRACT

A sliding shelf assembly for a refrigerator appliance is provided. The sliding shelf assembly includes a shelf support frame that is slidably mounted inside the chilled chamber of the refrigerator appliance. A connecting arm couples the shelf support frame to the door such that the shelf support frame slides out of the chilled chamber as the door is opened. Moreover, the shelf support frame slidably receives refrigerator shelves that may slide independently of the shelf support frame. The sliding shelf assembly thereby simplifies storage on the refrigerator shelves, improves accessibility of the chilled chamber, and improves consumer satisfaction with the refrigerator appliance.

20 Claims, 7 Drawing Sheets

(56) References Cited

U.S. PATENT DOCUMENTS

| | | | | |
|---|---|---|---|---|
| 8,806,884 | B2 | 8/2014 | Park et al. | |
| 9,074,810 | B2 | 7/2015 | Hwang et al. | |
| 2005/0275326 | A1* | 12/2005 | Lim | F25D 25/024 312/408 |
| 2006/0163984 | A1 | 7/2006 | Andersen | |
| 2010/0253191 | A1* | 10/2010 | Backhaus | A47B 96/16 312/309 |
| 2010/0307186 | A1* | 12/2010 | Kwon | F25D 23/028 62/407 |
| 2011/0030416 | A1 | 2/2011 | Hoffman | |
| 2011/0083464 | A1 | 4/2011 | Kettles | |
| 2011/0083465 | A1 | 4/2011 | Kim et al. | |
| 2012/0031136 | A1 | 2/2012 | Park | |
| 2012/0267992 | A1 | 10/2012 | Lee et al. | |
| 2015/0247666 | A1* | 9/2015 | Kim | F25D 23/04 312/404 |

* cited by examiner

SLIDING SHELF ASSEMBLY FOR A REFRIGERATOR APPLIANCE

FIELD OF THE INVENTION

The present subject matter relates generally to refrigerator appliances, and more particularly to sliding shelf systems for refrigerator appliances.

BACKGROUND OF THE INVENTION

Refrigerator appliances generally include a cabinet that defines a chilled chamber for receipt of food articles for storage. The refrigerator appliances can also include various storage components mounted within the chilled chamber and designed to facilitate storage of food items therein. Such storage components can include racks, bins, shelves, or drawers that receive food items and assist with organizing and arranging of such food items within the chilled chamber.

While food articles or other items stored in door bins or drawers may be conveniently accessed, items placed on shelves in the chilled chamber are often difficult to reach, particularly when placed near the back of the shelf. For example, due to the width and depth of conventional refrigerators and the fact that the shelves are fixed within the chilled chamber, a user must often reach deep into the chilled chamber to access items. Moreover, large items can obstruct or impede storage and access of smaller food items within the chilled chamber. Therefore, a user may need to remove items on the front of the shelf in order to reach items on the back of the shelf. These difficulties lead to consumer frustration and discomfort when placing items in or removing items from the chilled chamber.

Accordingly, a refrigerator appliance with features for improving storage of and access to food items stored within the chilled chamber of the refrigerator appliance would be useful. More particularly, a refrigerator appliance with features for manipulating the storage shelves to facilitate access to rear portions of the shelf would be particularly beneficial.

BRIEF DESCRIPTION OF THE INVENTION

The present subject matter provides a sliding shelf assembly for a refrigerator appliance. The sliding shelf assembly includes a shelf support frame that is slidably mounted inside the chilled chamber of the refrigerator appliance. A connecting arm couples the shelf support frame to the door such that the shelf support frame slides out of the chilled chamber as the door is opened. Moreover, the shelf support frame slidably receives refrigerator shelves that may slide independently of the shelf support frame. The sliding shelf assembly thereby simplifies storage on the refrigerator shelves, improves accessibility of the chilled chamber, and improves consumer satisfaction with the refrigerator appliance. Additional aspects and advantages of the invention will be set forth in part in the following description, or may be apparent from the description, or may be learned through practice of the invention.

In a first exemplary embodiment, a refrigerator appliance is provided. The refrigerator appliance defines a vertical direction, a lateral direction, and a transverse direction. The refrigerator appliance includes a cabinet defining a chilled chamber, a door being rotatably hinged to the cabinet to provide selective access to the chilled chamber, and a sliding shelf assembly slidably mounted within the chilled chamber. The sliding shelf assembly includes a shelf support frame, a slide assembly slidably mounting the shelf support frame within the chilled chamber, and a connecting arm operably coupling the shelf support frame to the door such that the shelf support frame slides in the transverse direction out of the chilled chamber as the door is opened.

According to another exemplary embodiment, a sliding shelf assembly for a refrigerator appliance is provided. The refrigerator appliance includes a cabinet defining a chilled chamber and a door rotatably hinged to the cabinet to provide selective access to the chilled chamber. The refrigerator appliance defines a vertical direction, a lateral direction, and a transverse direction. The sliding shelf assembly includes a substantially rectangular shelf support frame having a top portion, a bottom portion, a first side portion, and a second side portion. The sliding shelf assembly further includes two or more slide members slidably mounting the shelf support frame within the chilled chamber and a connecting arm operably coupling the shelf support frame to the door such that the shelf support frame slides in the transverse direction out of the chilled chamber as the door is opened.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
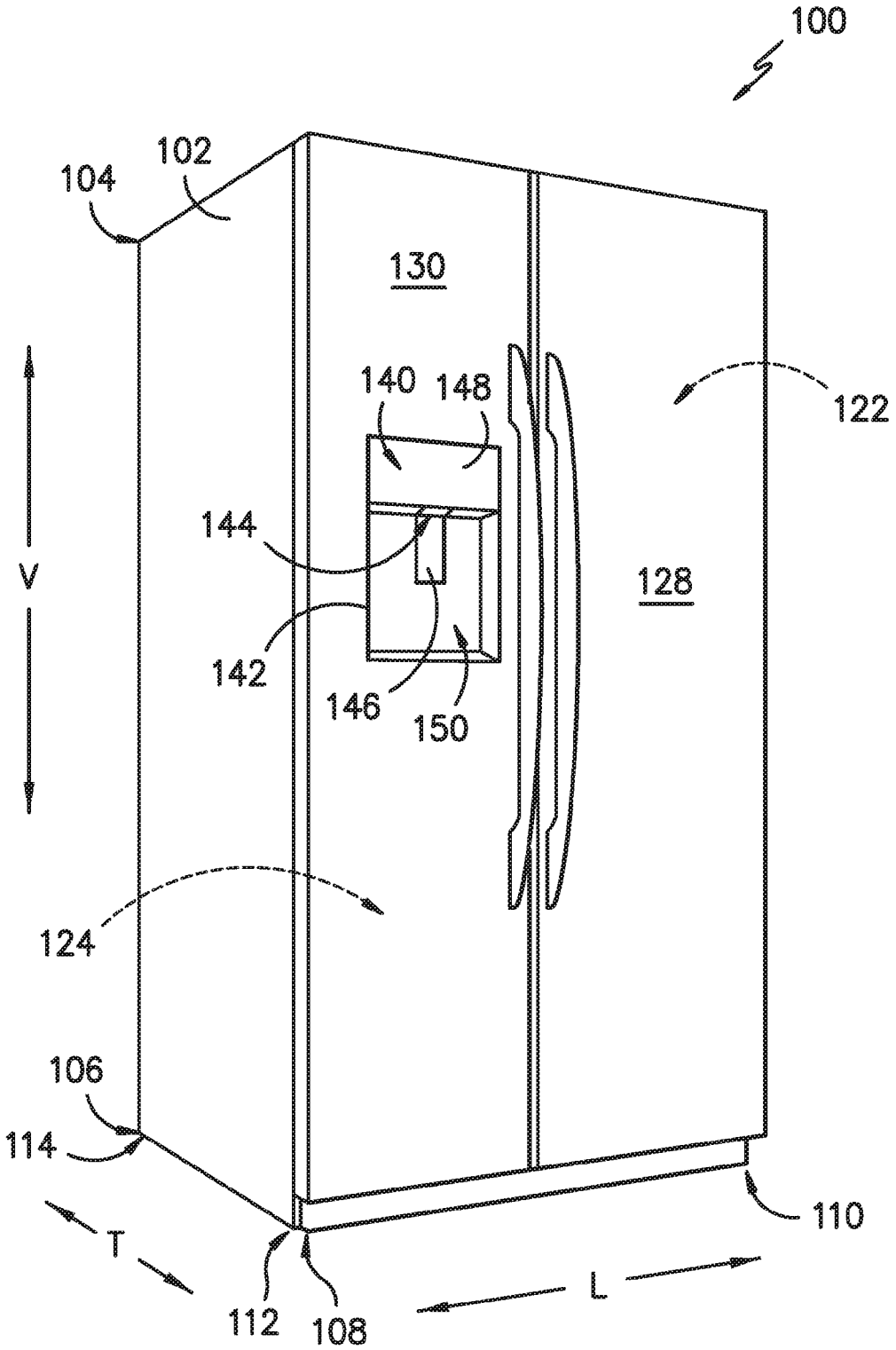
FIG. 1 provides a perspective view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 and a freezer chamber 124 positioned adjacent to each other and extending from top 104 to bottom 106 of housing 102. As such, refrigerator appliance 100 is generally referred to as a side-by-side refrigerator. It is recognized, however, that the benefits of the present disclosure apply to other types and styles of refrigerator appliances such as, e.g., a top mount refrigerator appliance or a bottom mount refrigerator appliance. Consequently, the description set forth herein is for illustrative purposes only and is not intended to be limiting in any aspect to any particular refrigerator chamber configuration.

Refrigerator door 128 and freezer door 130 are rotatably hinged to opposite edges of housing 102 for selectively accessing fresh food chamber 122 and freezer chamber 124, respectively. Refrigerator door 128 and freezer door 130 are shown in the closed configuration in FIG. 1. One skilled in the art will appreciate that other chamber and door configurations are possible and within the scope of the present invention.

Refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on freezer door 130. Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A control panel 148 is provided for controlling the mode of operation. For example, control panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open refrigerator doors 128. In the exemplary embodiment, dispenser recess 150 is positioned at a level that approximates the chest level of a user. Refrigerator door 128 may define an icebox compartment housing an icemaker and an ice storage bin (not shown) that are configured to supply ice to dispenser recess 150.

Figure 2:
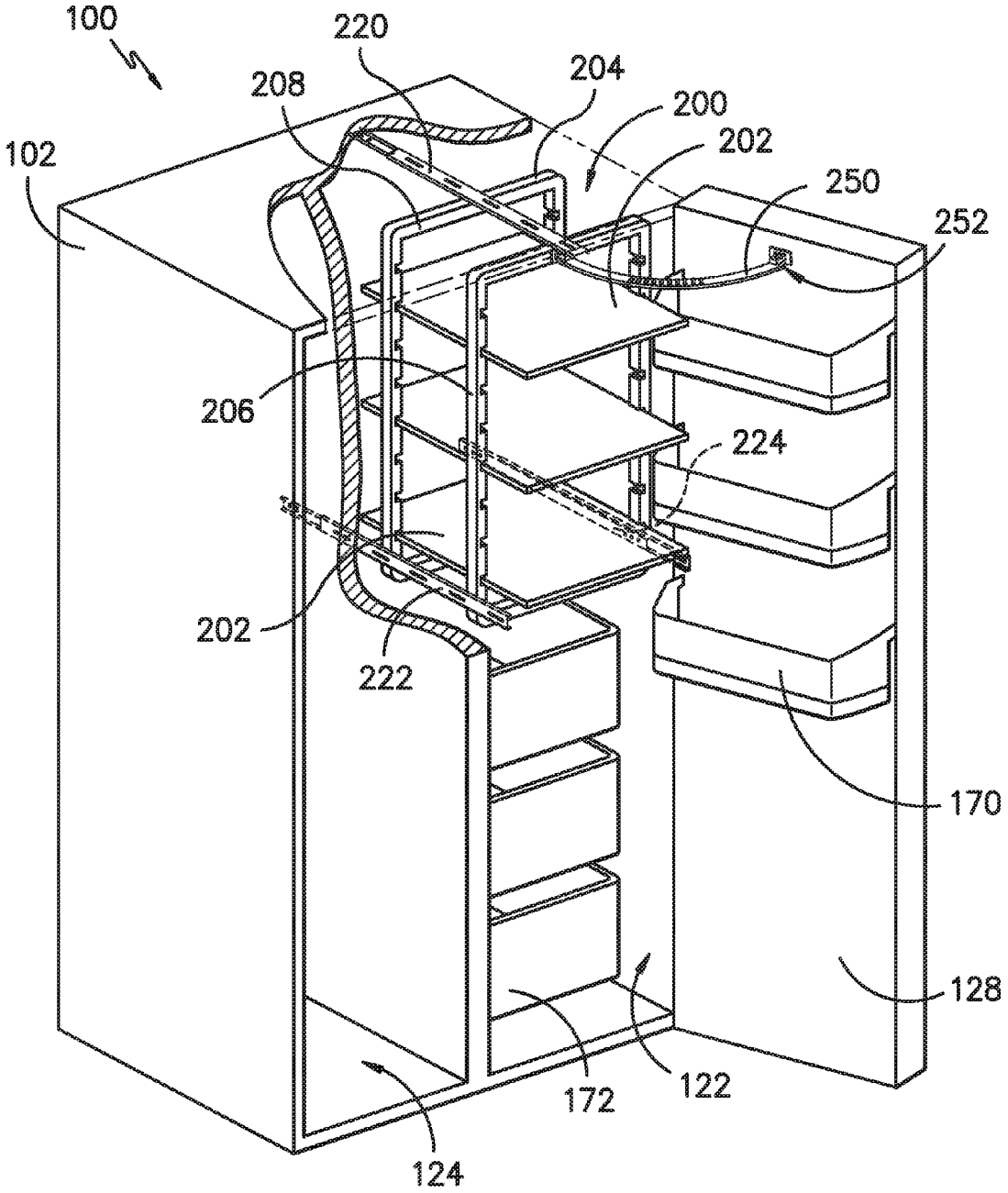
FIG. 2 provides a partial perspective view of the exemplary refrigerator appliance of FIG. 1, with the door of the fresh food chamber shown in an open position to reveal a sliding shelf assembly according to an exemplary embodiment of the present subject matter.

FIG. 2 provides a partial perspective view of refrigerator appliance 100 shown with refrigerator door 128 in the open position and freezer door 130 removed for clarity. As shown in FIG. 2, various storage components are mounted within fresh food chamber 122 to facilitate storage of food items therein as will be understood by those skilled in the art. In particular, the storage components may include bins 170 and drawers 172 that are mounted within fresh food chamber 122. In addition, as will be described in detail below, a sliding shelf assembly 200 may be mounted within fresh food chamber 122 to provide convenient access to items on shelves 202. Each of these storage components are configured for receipt of food items (e.g., beverages and/or solid food items) and may assist with organizing such food items.

Figure 3:
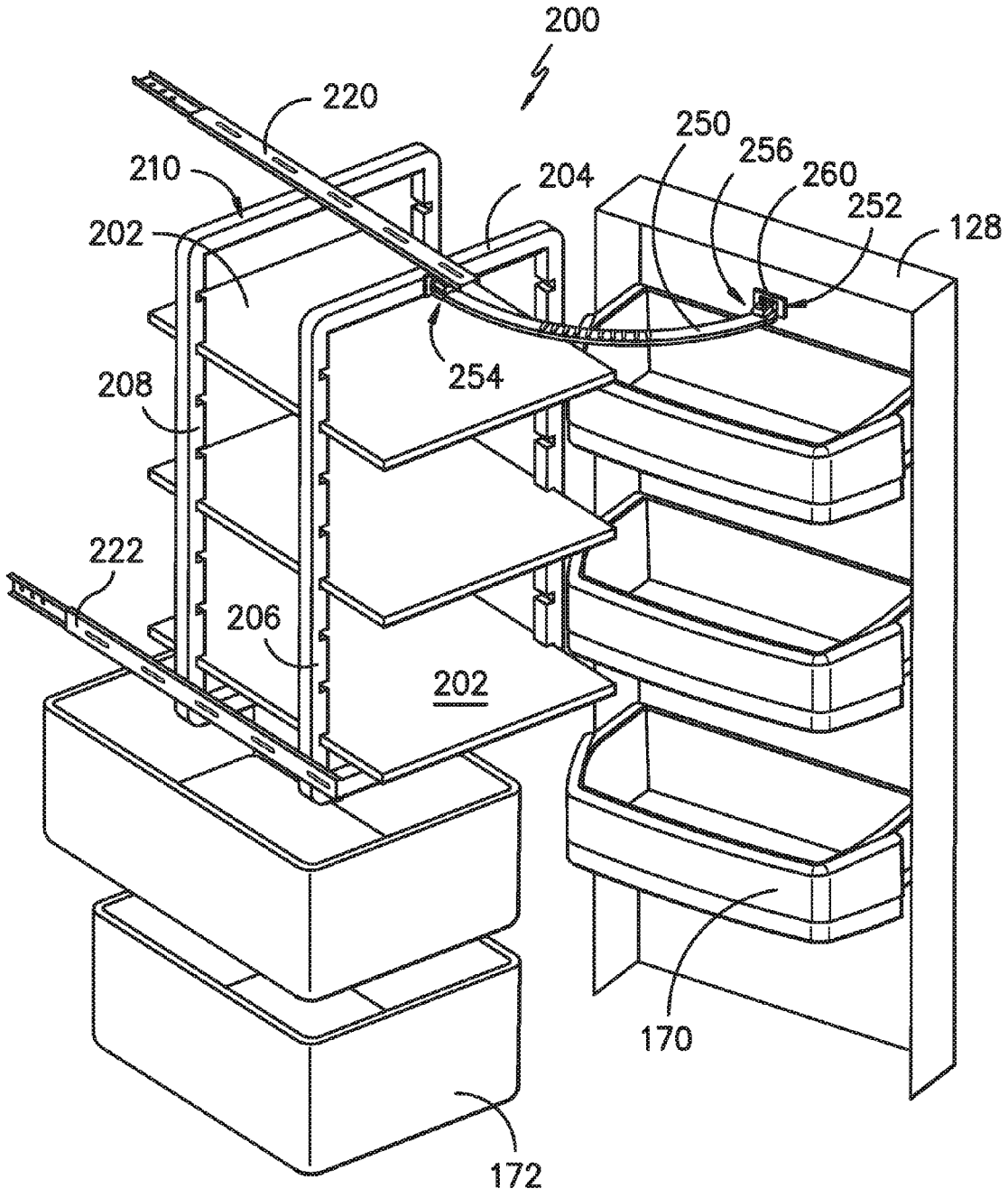
FIG. 3 provides a perspective view of the sliding shelf assembly of FIG. 2, with the remainder of the refrigerator appliance hidden for clarity.

Referring now to FIG. 3, sliding shelf assembly 200 may generally include a shelf support frame 204. Shelf support frame 204 may be any structure suitable for supporting shelves 202 within fresh food chamber 122. According to the illustrated embodiment, shelf support frame 204 includes two rectangular members that are substantially identical to each other and are spaced apart from each other along the transverse direction T. More specifically, first frame member 206 may be positioned in front of second frame member 208, and these members may be connected together using any suitably rigid connecting member. For example, according to the illustrated embodiment, first frame member 206 and second frame member 208 are connected by slide members.

Although the illustrated embodiment illustrates shelf support frame 204 as having two frame members 206, 208, one skilled in the art will appreciate that a single frame member or more than two frame members may be used according to an alternative exemplary embodiment. In addition, although shelf support frame 204 is illustrated being substantially rectangular, any other suitable shape may be used and shelf support frame 204 may be configured to support storage components other than shelves 202, e.g., storage bins.

Shelf support frame 204 may be constructed from any suitably rigid material, e.g., metal or plastic. In addition, shelf support frame 204 may be constructed as a single, integral piece, or may be constructed from several parts that are connected together, such as via suitable mechanical fasteners (such as screws, rivets, nut-bolt combinations, etc), bonding, etc. Whether formed from a single, integral piece or from multiple components, shelf support frame 204 may generally have a top frame member 210, a bottom frame member 212, a first side member 214, and a second side member 216.

As best illustrated in FIGS. 2 and 3, shelf support frame 204 is slidably mounted within fresh food chamber 122 using multiple slide members. More specifically, a first slide member 220 is positioned on top frame member 210 between shelf support frame 204 and housing 102. Similarly, a second slide member 222 and third slide member 224 are mounted to a first side member 214 and second side member 216 of shelf support frame 204, respectively. Although the illustrated embodiment shows three slide members, one skilled in the art will appreciate the any number of slide members may be used according to alternative embodiments. Together, slide members 220, 222, 224 slidably support shelf support frame 204 within fresh food chamber 122 and allow it to move along the transverse direction T out of fresh food chamber 122 when refrigerator door 128 is in the open position.

Each slide member 220, 222, 224 may include a guide and one or more slide members that move linearly relative to the guide via a suitable bearing arrangement. In an alternative embodiment, multiple slide members may telescope relative to each other. Slide members 220, 222, 224 may be constructed from any suitably rigid material, e.g., steel. Slide members 220, 222, 224 may be attached to shelf support frame 204 and housing 102 using any suitable mechanical fastener, such as screws, bolts, rivets, etc. Similarly, glue, snap-fit mechanisms, interference-fit mechanisms, or any suitable combination thereof may secure shelf support frame 204 to slide members 220, 222, 224. Other attachment means are also possible.

Figure 4:
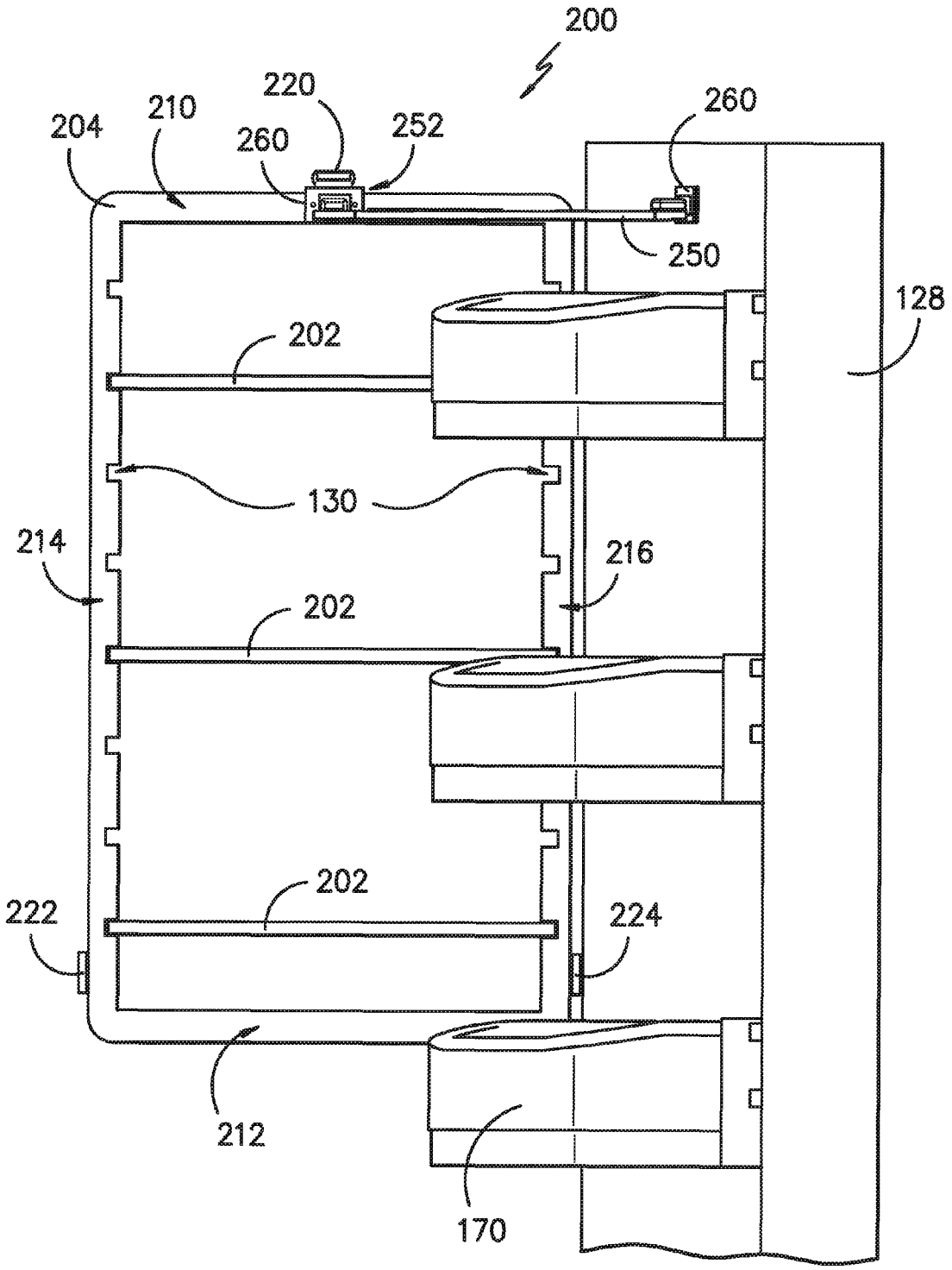
FIG. 4 provides a front view of the sliding shelf assembly of FIG. 2.

As best shown in FIG. 4, shelf support frame 204 may define a plurality of slots 230 on the interior sides of the first side member 214 and second side member 216. Notably, one set of slots 230 may include two slots 230 on first frame member 206 and two slots 230 on second frame member 208, such that all slots are positioned in the same horizontal plane. In this manner, slots 230 may be configured for slidably receiving shelves 202 and for supporting shelves in a horizontal orientation. As shown in the figures, shelf support frame 204 defines slots 230 along the entire length of first side member 214 and second side member 216. In this manner, a user may place shelves 202 in any suitable set of slots 230, thereby providing an easily modifiable and customizable food storage system to meet the consumer's particular needs.

Figure 5:
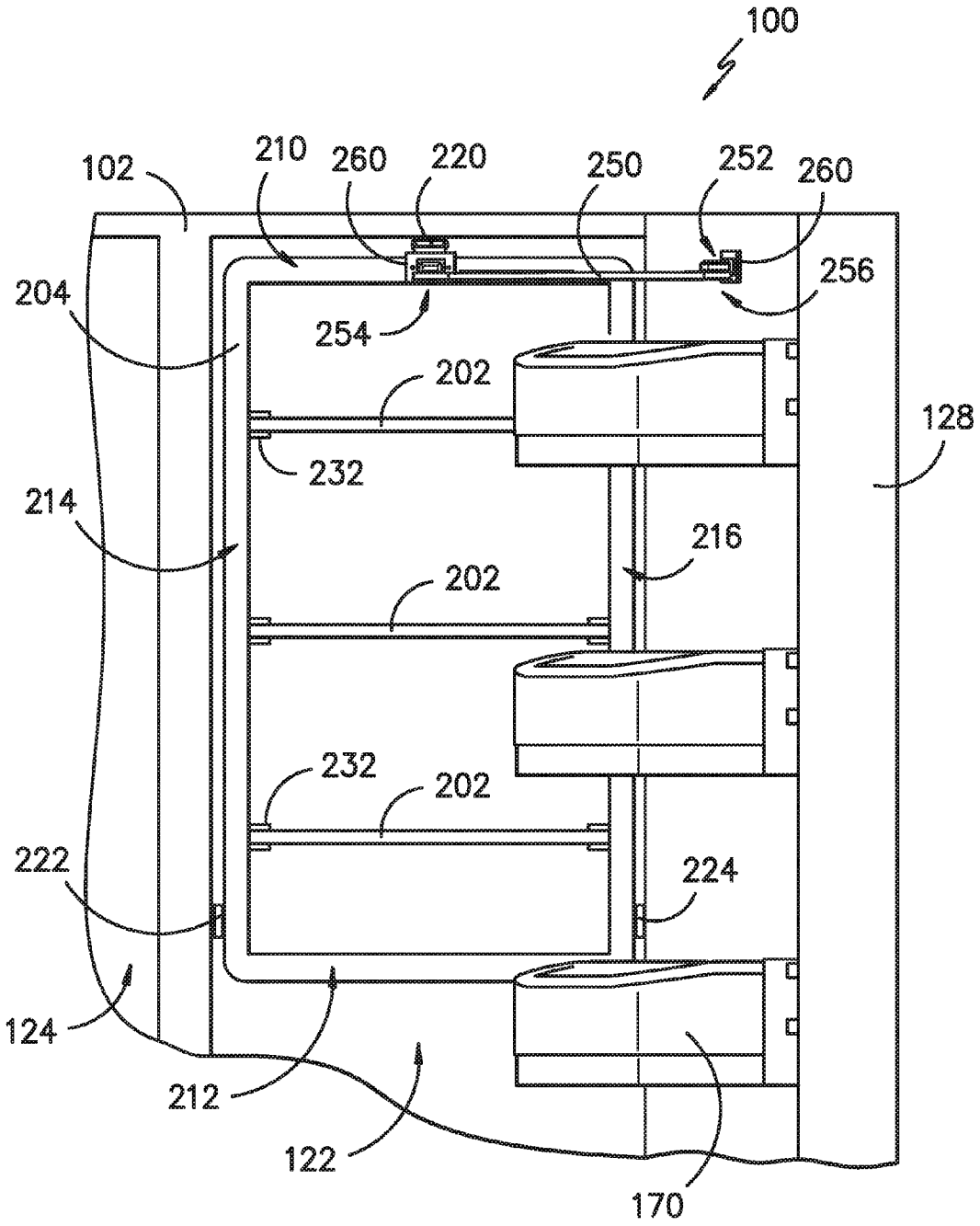
FIG. 5 provides a front view of a sliding shelf assembly according to an alternative exemplary embodiment of the present subject matter.
Figure 6:
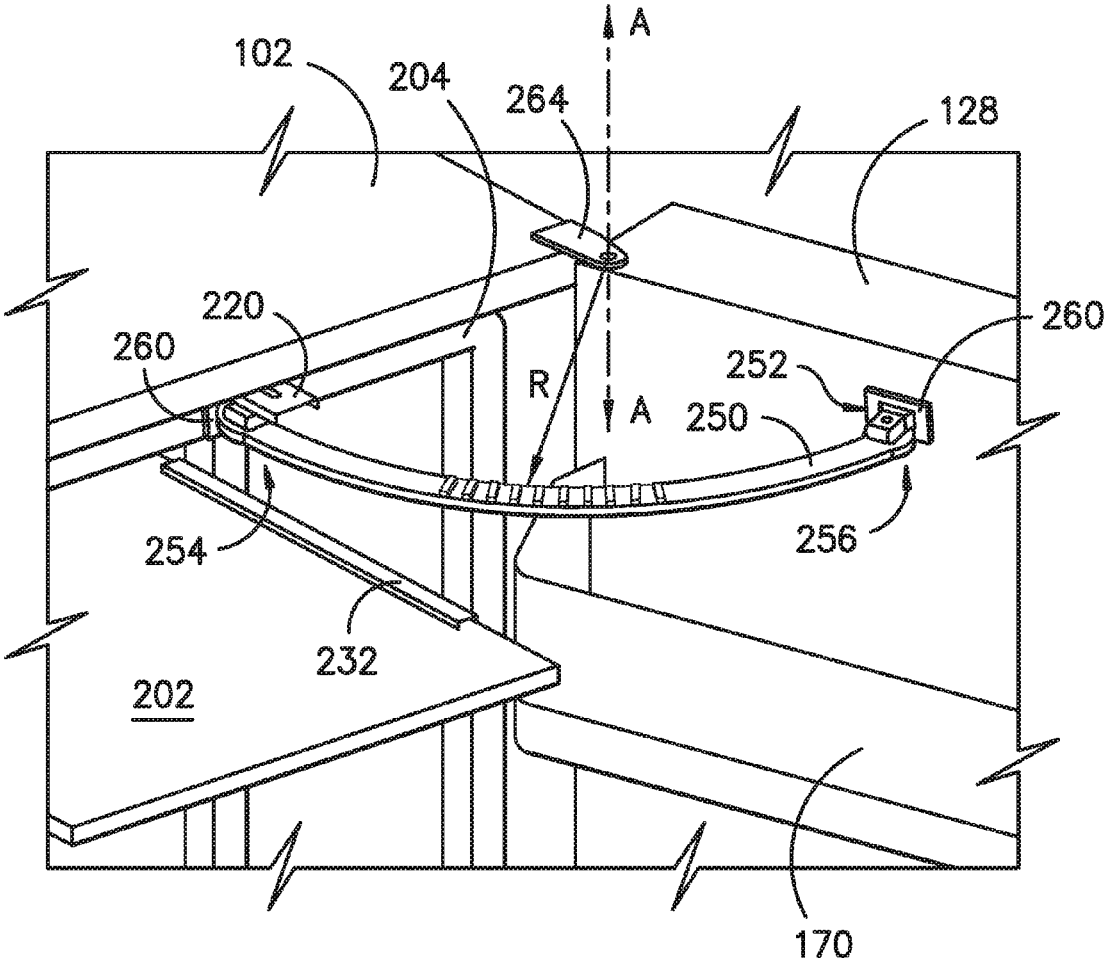
FIG. 6 provides a perspective view of the sliding shelf assembly of FIG. 5, illustrating a connecting arm between the sliding shelf assembly and the door.

Although slots 230 are integrally formed with shelf support frame 204, alternative exemplary embodiments may use other means for supporting shelves 202. For example, as shown in FIGS. 5 and 6, shelf support brackets 232 may be attached to shelf support frame 204 at various locations along first side member 214 and second side member 216. According to another exemplary embodiment, shelves 202 may be slidably mounted to shelf support frame 204 using any suitable slide member, e.g., similar to slide member 220. According to still another exemplary embodiment, shelves 202 may be permanently fixed to shelf support frame 204, e.g., using a suitable mechanical fastener or by integrally forming shelves 202 with shelf support frame 204.

Figure 7:
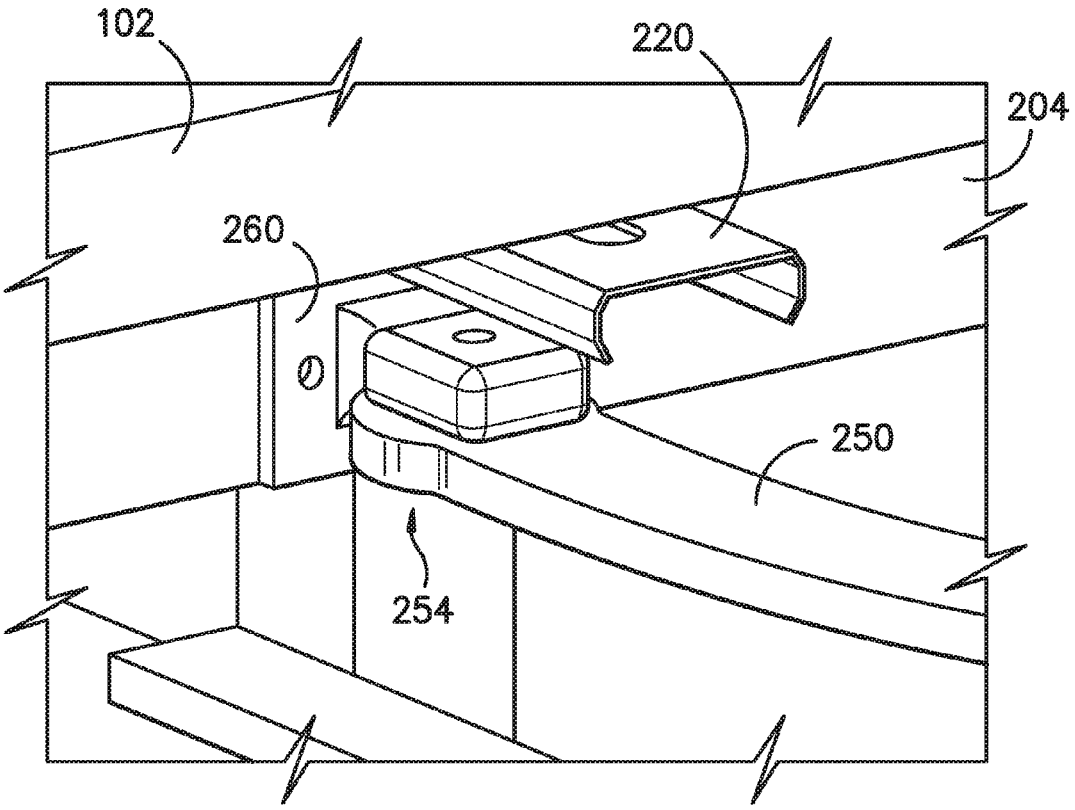
FIG. 7 provides a perspective view of a hinge of the connecting arm of the exemplary sliding shelf assembly of FIG. 5.
Figure 8:
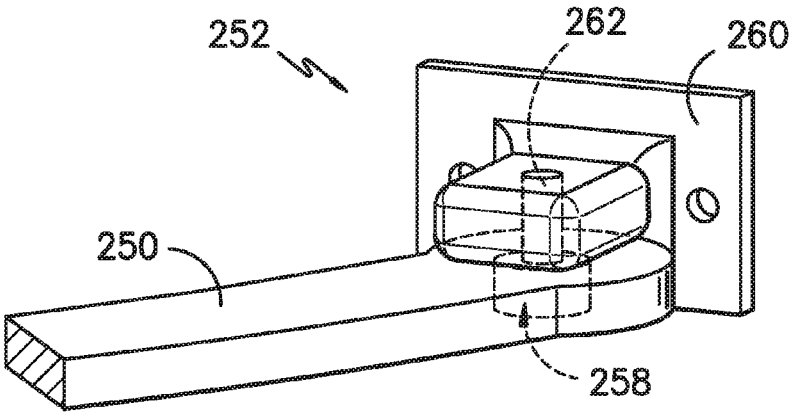
FIG. 8 provides a partial perspective view of a hinge of the connecting arm of the exemplary sliding shelf assembly of FIG. 5.

Referring now to FIGS. 6 through 8, sliding shelf assembly 200 may further include a connecting arm 250 that operably couples shelf support frame 204 to refrigerator door 128 such that shelf support frame 204 slides in the transverse direction T out of the fresh food chamber 122 as refrigerator door 128 is opened. Although the illustrated embodiment shows a single connecting arm 250 connected to top frame member 210 of shelf support frame 204, one skilled in the art will appreciate that more than one connecting arm may be used and connecting arm 250 may be connected at any suitable location on shelf support frame 204. Notably, by pivotally attaching connecting arm 250 to top frame member 210, user access is not impeded, or is at least less obstructed by connecting arm 250 when refrigerator door 128 is in the open position.

Connecting arm 250 may be constructed of any suitably rigid material, e.g., metal or plastic. Connecting arm 250 may be pivotally mounted to shelf support frame 204 and refrigerator door 128 using any suitable connection mechanism. According to the illustrated exemplary embodiment, connecting arm 250 is pivotally connected using a pin joint 252. More specifically, first end 254 and second end 256 of connecting arm 250 may each define an aperture 258. Mounting flanges 260 may be attached to each of shelf support frame 204 and refrigerator door 128 and may be configured to receive a pin 262. Pin 262 may pass through apertures 258 in each end 254, 256 of connecting arm 250 to pivotally join connecting arm 250 to mounting flanges 260 and operably couple shelf support frame 204 to refrigerator door 128.

As shown in the illustrated embodiment, connecting arm 250 is an arcuate member that is connected approximately at the center of top frame member 210. More specifically, as best shown in FIG. 6, connecting arm 250 has a radius R that originates near a hinge 264 of refrigerator door 128. In this manner, hinge 264 defines an axis of rotation A about which refrigerator door 128 and connecting arm 250 pivot when refrigerator door 128 is moved between an open position and a closed position. However, connecting arm 250 may be any other suitable shape and may be connected to shelf support frame 204 at any other suitable location. Indeed, one skilled in the art will appreciate that the size, geometry, and positioning of connecting arm 250 may be adjusted as needed to affect the motion of shelf support frame 204 as refrigerator door 128 is opened and closed. In addition, the location of connecting arm 250 may be adjusted to minimize interference with normal user operation of refrigerator appliance 100 and to minimize interference during consumer usage and access to fresh food chamber 122.

Using sliding shelf assembly 200, as refrigerator door 128 is opened by pivoting it on its hinges, connecting arm 250 pulls shelf support frame 204 along the transverse direction T out of fresh food chamber 122. For example, according to the illustrated embodiment, refrigerator door 128 is in the fully open position when it is opened about 120 degrees relative to the front surface of refrigerator appliance 100. When refrigerator door 128 is swings to the fully opened positioned, shelf support frame 204 slides approximately eight inches along the transverse direction T.

Once shelf support frame 204 is in its extended position outside of fresh food chamber 122, a user may easily access items stored on shelves 202, even if those items are placed on the very back of the shelf 202. Moreover, to further improve access to stored items, shelves 202 may slide out from shelf support frame 204 as described above. Sliding shelf assembly 200 thereby simplifies storage on the refrigerator shelves 202 by allowing items to be place anywhere on the shelf, while allowing a consumer to easily and comfortably access those items.

Although the description above describes sliding shelf assembly 200 as being configured inside fresh food chamber 122 of refrigerator appliance 100, one skilled in the art will appreciate that embodiments of the present subject matter may be alternatively employed in freezer chamber 124 or any other suitable refrigerator compartment. Indeed, aspects of the present subject matter may be extended to apply to other consumer appliances. For example, aspects of the present subject matter may be used in a cooking oven to slide out one or more oven racks when the oven door is opened. Other applications and modifications of the present subject matter are possible and such applications are considered to be within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the refrigerator appliance comprising:

a cabinet defining a chilled chamber;

a door being rotatably hinged to the cabinet to provide selective access to the chilled chamber;

a sliding shelf assembly slidably mounted within the chilled chamber, the sliding shelf assembly comprising:

a shelf support frame;

a slide assembly slidably mounting the shelf support frame within the chilled chamber; and a connecting arm assembly consisting of a connecting arm positioned at a top of the shelf support frame along the vertical direction and operably coupling the shelf support frame to the door such that the shelf support frame slides in the transverse direction out of the chilled chamber as the door is opened.

2. The refrigerator appliance of claim 1, wherein the connecting arm is a rigid arcuate member having a first end pivotally connected to the shelf support frame and a second end pivotally connected to the door.

3. The refrigerator appliance of claim 2, wherein the first end is pivotally connected to a top portion of the shelf support frame and the second end is pivotally connected to a top portion of the door.

4. The refrigerator appliance of claim 1, wherein the slide assembly comprises a first slide member located on a top of the shelf support frame, a second slide member positioned on a first lower side of the shelf support frame, and a third slide member positioned on an opposite second lower side of the shelf support frame.

5. The refrigerator appliance of claim 1, wherein the shelf support frame is substantially rectangular.

6. The refrigerator appliance of claim 5, wherein a plurality of shelf support brackets are mounted to the shelf support frame and configured for slidably receiving shelves.

7. The refrigerator appliance of claim 5, wherein the shelf support frame defines a plurality of notches along a first inner side and a second inner side of the shelf support frame, the plurality of notches being configured for slidably receiving shelves.

8. The refrigerator appliance of claim 1, wherein the shelf support frame comprises a first frame member and an identical second frame member, the first frame member and the second frame member being rigidly connected and spaced apart along the transverse direction.

9. The refrigerator appliance of claim 1, wherein the shelf support frame is configured to slide along the transverse direction approximately eight inches when the door is opened to about 120 degrees.

10. The refrigerator appliance of claim 1, wherein the sliding shelf assembly further comprises:

one or more shelves, each of the one or more shelves being slidably mounted to the shelf support frame by a shelf sliding means.

11. A sliding shelf assembly for a refrigerator appliance, the refrigerator appliance comprising a cabinet defining a chilled chamber and a door rotatably hinged to the cabinet to provide selective access to the chilled chamber, the refrigerator appliance defining a vertical direction, a lateral direction, and a transverse direction, the sliding shelf assembly comprising:

a substantially rectangular shelf support frame having a top portion, a bottom portion, a first side portion, and a second side portion;

two or more slide members slidably mounting the shelf support frame within the chilled chamber; and a connecting arm assembly consisting of a connecting arm positioned at a top of the shelf support frame along the vertical direction and operably coupling the shelf support frame to the door such that the shelf support frame slides in the transverse direction out of the chilled chamber as the door is opened.

12. The sliding shelf assembly of claim 11, wherein the connecting arm is a rigid arcuate member having a first end pivotally connected to the shelf support frame and a second end pivotally connected to the door.

13. The sliding shelf assembly of claim 12, wherein the first end is pivotally connected to the top portion of the shelf support frame and the second end is pivotally connected to a top portion of the door.

14. The sliding shelf assembly of claim 11, wherein the sliding shelf assembly comprises a first slide member located on the top portion of the shelf support frame, a second slide member positioned on the first side portion of the shelf support frame, and a third slide member positioned on the second side portion of the shelf support frame.

15. The sliding shelf assembly of claim 11, wherein a plurality of shelf support brackets are mounted to the shelf support frame and configured for slidably receiving shelves.

16. The sliding shelf assembly of claim 11, wherein the shelf support frame defines a plurality of sets of slots, each set of slots comprising two or more slots configured for slidably receiving and supporting one of a plurality of shelves in a horizontal orientation.

17. The sliding shelf assembly of claim 16, wherein the sliding shelf assembly comprises more sets of slots than plurality of shelves, and each of the plurality of shelves may be slidably received within any of the sets of slots.

18. The sliding shelf assembly of claim 11, wherein the shelf support frame comprises a first frame member and an identical second frame member, the first frame member and the second frame member being rigidly connected and spaced apart along the transverse direction.

19. The sliding shelf assembly of claim 11, wherein the shelf support frame is configured to slide along the transverse direction approximately eight inches when the door is opened to about 120 degrees.

20. The sliding shelf assembly of claim 11, further comprising:

one or more shelves, each of the one or more shelves being slidably mounted to the shelf support frame by a shelf sliding means.

* * * * *